US008765344B2

(12) United States Patent
Lee et al.

(10) Patent No.: US 8,765,344 B2
(45) **Date of Patent: *Jul. 1, 2014**

(54) ELECTROPHOTOGRAPHIC TONER AND METHOD OF PREPARING THE SAME

(75) Inventors: Jun-young Lee, Seoul (KR); Kyeong Pang, Suwon-si (KR); Tae-hoe Koo, Suwon-si (KR); Su-bum Park, Suwon-si (KR); Ju-yeon Lee, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 122 days.

This patent is subject to a terminal disclaimer.

(21) Appl. No.: 13/367,859

(22) Filed: Feb. 7, 2012

(65) Prior Publication Data

US 2012/0202149 A1 Aug. 9, 2012

(30) Foreign Application Priority Data

Feb. 8, 2011 (KR) ..... 10-2011-0011111

(51) Int. Cl.
*G03G 9/093* (2006.01)

(52) U.S. Cl.
USPC ..... 430/108.9; 430/108.5; 430/109.3; 430/110.2; 430/110.4

(58) Field of Classification Search
USPC ..... 430/108.9, 109.3, 110.2, 110.4, 108.5
See application file for complete search history.

(56) References Cited

U.S. PATENT DOCUMENTS 6,096,465 A * 8/2000 Kadokura et al. ..... 430/137.14
6,887,638 B2 * 5/2005 Ishiyama et al. ..... 430/110.2

FOREIGN PATENT DOCUMENTS

JP 2002-6553 1/2002
KR 10-2004-0105240 12/2004

OTHER PUBLICATIONS

RCA Electro-Optics Handbook, Technical Series EOH-11, RCA Corporation, PA (1974), pp. 13-14.*

* cited by examiner

*Primary Examiner* — Janis L Dote
(74) *Attorney, Agent, or Firm* — Staas & Halsey LLP

(57) ABSTRACT

An electrophotographic toner and a method of preparing the same, the electrophotographic toner including a binder that includes two kinds of resin having different weight average molecular weights, a colorant, and a releasing agent.

5 Claims, 2 Drawing Sheets

ELECTROPHOTOGRAPHIC TONER AND METHOD OF PREPARING THE SAME

CROSS-REFERENCE TO RELATED APPLICATIONS

This application claims the benefit of Korean Patent Application No. 10-2011-0011111, filed on Feb. 8, 2011, in the Korean Intellectual Property Office, the disclosure of which is incorporated herein in its entirety by reference.

BACKGROUND

1. Field

The present general inventive concept relates to an electrophotographic toner and a method of preparing the electrophotographic toner.

2. Description of the Related Art

Developers to make electrostatic images or electrostatic latent images visible in an electrographic process or an electrostatic recording process may be classified into two-component developers and one-component developers. Two-component developers include toner and carrier particles, while one-component developers consist essentially of toner. One-component developers may be further classified into magnetic and nonmagnetic developers. In order to increase the fluidity of toner, nonmagnetic one-component developers often contain a fluidizing agent, such as colloidal silica. Typically, toner also includes coloring particles obtained by dispersing a colorant, such as carbon black, or other additives, in latex.

Methods for preparing toner include pulverization and polymerization processes. For pulverization processes, toner is obtained by melting and mixing a synthetic resin with a colorant, and optionally, other additives. The pulverized toner undergoes classifying until the particles of a desired size are obtained. In contrast, polymerization processes provide toner by uniformly dissolving or dispersing a colorant, a polymerization initiator and, optionally, various additives, such as a cross-linking agent and an antistatic agent, in a polymerizable monomer. The polymerizable monomer composition is then dispersed in an aqueous dispersive medium, which includes a dispersion stabilizer, using an agitator to shape minute liquid droplet particles. The temperature of the composition is subsequently increased, and suspension polymerization is performed to obtain polymerized toner having coloring polymer particles of a desired size.

Toner used in an imaging apparatus is obtained by pulverization. However, for pulverization processes it is difficult to precisely control the particle size, geometric size distribution, and the structure of toner. Thus, it is difficult to separately control the major characteristics of toner, such as charging characteristics, fixability, flowability, and preservation characteristics, using these processes.

Recently, polymerized toner has become increasingly used, due to a simpler manufacturing process, which does not require sorting the particles, and the ease of controlling the size of the particles. When toner is prepared through a polymerization process, polymerized toner having a desired particle size and particle size distribution can be obtained without pulverizing or sorting. In order to control uniformity of particle size and shape of toner in a polymerization process, an agglomeration process for preparing agglomerated toner may be used through the use of a metal salt such as $MgCl_2$, and the like, or a polymeric material such as polyaluminum chloride (PAC).

By using a metal salt-based agglomerating agent it is possible to reliably control the particle size and particle size distribution of toner or to form a capsule structure with a shell, which is practically applied. However, it is still difficult to uniformly control the particle size and shape of toner. Typically, the particle size above a middle point of the particle size distribution of toner is highly controllable; however, smaller toner particles below the middle point of the particle size distribution tend to be more spherical than desired, and may cause problems in blade cleaning during electrophotographic processes.

To ensure both high gloss and a wide fusing latitude of toner, the agglomerating process may be controlled to form a capsuled toner structure, which ensures that a colorant and a releasing agent are not exposed to the surface of the toner, thereby improving charging uniformity, flowability, and thermal storage stability.

However, black toner still has problems with the use of carbon black colorant, in terms of image quality and transfer controllability. To address these problems, controlling the distribution of the colorant in the inside of a toner particle is required to improve image quality.

SUMMARY

Additional aspects and/or advantages will be set forth in part in the description which follows and, in part, will be apparent from the description, or may be learned by practice of the invention.

According to the embodiments of the present invention, there is provided an electrophotographic toner including: a binder including two resins having different weight average molecular weights; carbon black; and a releasing agent, wherein the electrophotographic toner has a molecular weight distribution curve measured by gas permeation chromatography (GPC), with a main peak in a region of from about $8.0\times10^3$ g/mol to about $4.0\times10^4$ g/mol and a shoulder starting point in a region greater than or equal to about $1.0\times10^5$ g/mol; the electrophotographic toner has a weight average molecular weight of from about $5.0\times10^4$ g/mol to about $4.0\times10^5$ g/mol and a Z-average molecular weight of from about $1.0\times10^5$ g/mol to about $6.0\times10^6$ g/mol; free carbon black in washer liquid of deionized water containing 1 wt % of the electrophotographic toner has a UV absorbance of about 0 to about 0.01 at 600 nm; and the electrophotographic toner has a log value of resistance of from about 11 to about 14.

The electrophotographic toner may have a structure including a core and a shell layer, and the shell layer may have a thickness of about 0.1 μm to about 0.5 μm.

The electrophotographic toner may include iron (Fe) in an amount of from about $1.0\times10^3$ ppm to about $1.0\times10^4$ ppm, and silicon (Si) in an amount of from about $1.0\times10^3$ ppm to about $5.0\times10^3$ ppm.

A [S]/[Fe] ratio of the toner may be from about $5.0\times10^{-4}$ to about $5.0\times10^{-2}$, where [S] and [Fe] respectively denote the intensities of S and Fe measured by X-ray fluorescence spectrometry.

An average particle diameter of the electrophotographic toner may be from about 4.0 μm to about 9.0 μm.

The electrophotographic toner may have a GSDp of from about 1.0 to about 1.35, and a GSDv of from about 1.0 to about 1.3.

According to another embodiment of the present invention, there is provided a method of preparing an electrophotographic toner, the method including: mixing primary binder particles including two resin latexes having different weight average molecular weights, a colorant dispersion, and a releasing agent dispersion together to produce a mixed solution; adding an agglomerating agent solution to the mixed solution to produce core-layer particles; and coating the core-layer particles with shell-layer particles including secondary binder particles to produce the toner particles, wherein the secondary binder particles are prepared by polymerizing at least one polymerizable monomer, wherein the electrophotographic toner includes the electrophotographic toner described above.

The two resin latexes may include a low-molecular weight resin latex having a weight average molecular weight of from about $1.3\times10^4$ g/mol to about $3.0\times10^4$ g/mol, and a large-molecular weight resin latex having a weight average molecular weight of from about $1.0\times10^5$ g/mol to about $5.0\times10^6$ g/mol.

A weight ratio of the low-molecular weight resin latex to the large-molecular weight resin latex may be from about 99:1 to about 70:30.

The step of coating the core-layer particles with the shell-layer particles may include: a) agglomerating the core-layer particles and the shell-layer particles at a temperature at which the core-layer particles and the shell-layer particles have a shear storage modulus (G') of about $1.0\times10^8$ to about $1.0\times10^9$ Pa; b) stopping the agglomerating of the step a) when an average particle diameter of the toner particles produced in the step a) reaches about 70% to about 100% of the average particle diameter of the final toner particles; and c) fusing and unifying the toner particles produced in the step b) at a temperature at which the toner particles produced in the step b) have a shear storage modulus (G') of about $1.0\times10^4$ to about $1.0\times10^9$ Pa.

The method may further include coating the secondary toner particles with tertiary binder particles.

The releasing agent dispersion may include a paraffin-based wax and an ester-based wax.

An amount of the ester-based wax may be from about 1 to about 35 wt % based on a total weight of the paraffin-based wax and the ester-based wax.

The agglomerating agent may include a Si- and Fe-containing metal salt.

The agglomerating agent may include polysilicate iron.

The agglomerating agent solution may have a pH of about 2.0 or less.

BRIEF DESCRIPTION OF THE DRAWINGS

The above and other features and advantages of the present general inventive concept will become more apparent by describing in detail exemplary embodiments thereof with reference to the attached drawings in which.

DETAILED DESCRIPTION

Figure 1:
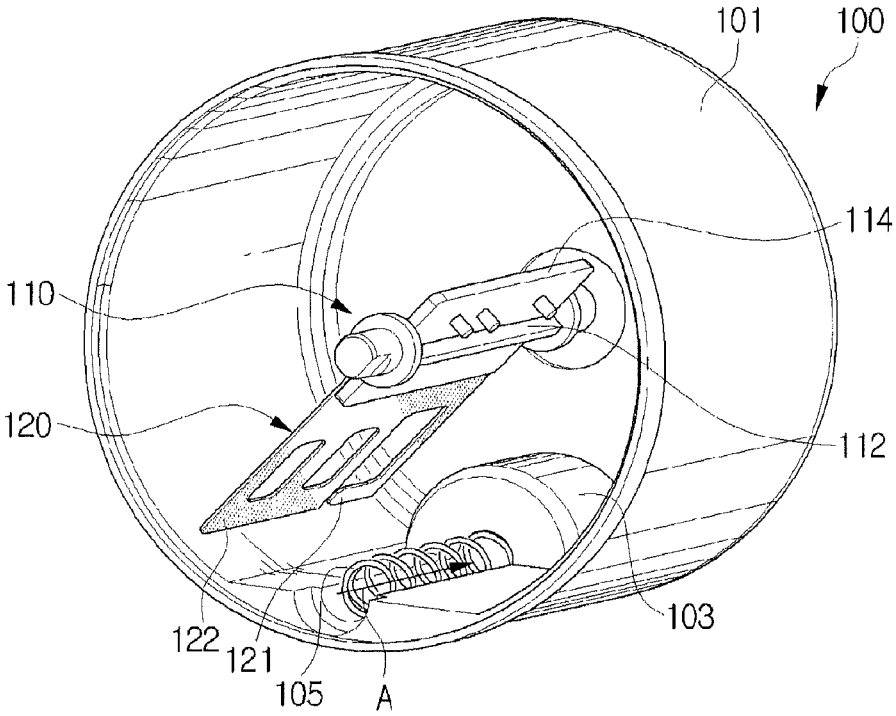
FIG. 1 is a perspective view of a toner supplying unit according to an embodiment of the present general inventive concept.

Reference will now be made in detail to the embodiments, examples of which are illustrated in the accompanying drawings, wherein like reference numerals refer to the like elements throughout. The embodiments are described below to explain the present invention by referring to the figures.

The embodiments of the present invention will now be described more fully with reference to the accompanying drawings, in which exemplary embodiments of the present general inventive concept are shown.

The embodiments of the present invention will now be described more fully with reference to several embodiments thereof and to the accompanying drawings.

According to an embodiment of the present invention, an electrophotographic toner includes a binder including two kinds of resin having different weight average molecular weights, a colorant, and a releasing agent, wherein the electrophotographic toner has a molecular weight distribution curve, as measured by gas permeation chromatography (GPC), with a main peak in a region of from about $8.0\times10^3$ g/mol to about $4.0\times10^4$ g/mol and a shoulder starting point in a region greater than or equal to about $1.0\times10^5$ g/mol, has a weight average molecular weight of from about $5.0\times10^4$ g/mol to about $4.0\times10^5$ g/mol, and a Z-average molecular weight of from about $1.0\times10^5$ g/mol to about $6.0\times10^6$ g/mol, and has a log value of resistance of from about 11 to about 14; and free carbon black in 1 wt % of the toner in deionized water has a ultraviolet (UV) absorbance of from about 0 to about 0.01 at 600 nm.

The molecular weight of toner affects gloss and fixability of the toner. A molecular weight distribution of a binder consisting of polymer resin mostly corresponds to a molecular weight distribution of the toner.

In particular, when a single kind of binder resin is used, the molecular weight distribution of the toner may form one normal distribution curve. However, when two kinds of binder resin, one having a low molecular weight, and the other having a large molecular weight, are used, a main molecular weight distribution curve may appear in a molecular weight distribution region of the low-molecular weight resin, and a gentle curve, a so-called "shoulder", may appear in a molecular weight distribution region of the large-molecular weight resin, immediately after an edge of the steep main molecular weight distribution curve. If the amount of the large-molecular weight resin is excessive, dual peaks may appear. In this case, anti-offset characteristics may be satisfactory, but high gloss may not be attained.

The two different resins in the electrophotographic may work independently from each other. The low-molecular weight resin, whose molecular weight is smaller than a critical molecular weight, is not entangled in molecular chains, which may lead to a minimum fusing temperature (MFT) and gloss. On the contrary, the large-molecular weight resin is excessively entangled in molecular chains, which maintains elasticity consistently at high temperatures, ensuring anti-offset characteristics of the toner. Thus, by using the low-molecular weight resin and the high-molecular weight resin together, toner's rheological properties may be controlled.

For example, in a main molecular weight curve the electrophotographic toner may have a peak in a region from about $8\times10^3$ g/mol to about $4.0\times10^4$ g/mol, and in some embodiments, may have a peak in a region from about $1.0\times10^4$ g/mol to about $3.5\times10^4$ g/mol, and in some other embodiments, may have a peak in a region from about $1.3\times10^4$ g/mol to about $2.5\times10^4$ g/mol. When the main peak appears within these ranges, the electrophotographic toner may be improved in terms of melt viscosity, gloss, and fixability.

In the molecular weight distribution curve of the electrophotographic toner, a small curve with a gentle slope appears immediately after the end of the sharply decreasing slope of the main peak, which is defined as the "shoulder start point" at which the slope of the main peak begins to inflect.

The shoulder start point may be in a region equal to or greater than about $1.0\times10^5$ g/mol, and in some embodiments, may be in a region of from about $1.5\times10^5$ g/mol to about $5.0\times10^6$ g/mol, and in some embodiments, may be in a region of from about $2.0\times10^5$ to about $4.5\times10^6$ g/mol.

When the shoulder start point is within these ranges, the electrophotographic toner may have improved anti-offset characteristics at high temperatures, and a wider fusing latitude, and improved durability and gloss.

The electrophotographic toner may have a weight average molecular weight of from about $5.0\times10^4$ g/mol to about $4.0\times10^5$ g/mol, and in some embodiments, may have a weight average molecular weight of from about $6.0\times10^4$ g/mol to about $2.0\times10^5$ g/mol, and in some other embodiments, may have a weight average molecular weight of from about $6.5\times10^4$ g/mol to about $1.5\times10^5$ g/mol. The electrophotographic toner may have a Z-average molecular weight of from about $1.0\times10^5$ g/mol to about $6.0\times10^6$ g/mol, and in some embodiments, may have a Z-average molecular weight of from about $8.0\times10^5$ g/mol to about $5.5\times10^6$ g/mol, and in some other embodiments, may have a Z-average molecular weight of from about $1.5\times10^6$ g/mol to about $5.0\times10^6$ g/mol.

When having a weight average molecular weight of greater than or equal to about $5.0\times10^4$ g/mol, the electrophotographic toner may have enhanced durability, improved high-temperature preservation characteristics, and suppressed blocking characteristics. When having a weight average molecular weight smaller than or equal to about $4.0\times10^5$ g/mol, the electrophotographic toner may have high consistent fixability.

The Z-average molecular weight of toner indicates a distribution of polymer in the molecular weight distribution of the toner, and is significant since it reflects toughness of separated molten toner. When the Z-average molecular weight is in the range from about $1.0\times10^5$ g/mol to about $6.0\times10^6$ g/mol, the electrophotographic toner may have improved anti-offset characteristics and improved gloss.

A carbon black colorant, compared to other colorants used in toner, has a smaller primary particle diameter and a larger specific surface area, and is harder to be uniformly distributed in toner. Thus, the carbon black may be concentrated on a toner surface, and free carbon black is more likely to be separated from the toner surface.

Carbon black is conductive and may cause leakage of charges if excessive carbon black is present on the toner surface.

Therefore, for toner using carbon black as a colorant, to control the amount of free carbon black in the toner is very important. The amount of free carbon black may be measured by ultra-sonicating an amount of toner in deionized water, centrifuging the ultra-sonicated product to separate a supernatant, and measuring UV absorbance of the supernatant at 600 nm.

In some embodiments, free carbon black in an ultra-sonicated product of 1 wt % of the electrophotographic toner in deionized water may have a UV absorbance of from about 0 to about 0.01 at 600 nm.

When the UV absorbance of the free carbon black at 600 nm is within this range, the electrophotographic toner may not undergo a flowability reduction that may occur by the free carbon black, may have improved frictional charging characteristics, and may attain halftone images with improved reproducibility and a sufficient image concentration.

In electrophotography, methods for developing and making a latent image visible on a photoconductive photoreceptor by using toner may be categorized into either a two-component development method or a one-component development method. For two-component development methods, friction between black toner and carriers may induce charges with an opposite polarity with respect to a latent image to allow the black toner to be attached to the latent image and develop the latent image by electrostatic attraction. For one-component development methods, a thin toner layer is formed on a developing roll to make a latent image visible.

Therefore, an insulating or high-resistance toner is used to ensure a high charge level sufficient to develop the latent image. The toner may have a log value of resistance of from about 11 to about 14.

When the log resistance of the toner is within this range, the toner may have improved charging characteristics and uniform charge distribution. In addition, the toner may be prevented from losing charges, and thus maintain an appropriate amount of charges.

In some embodiments, the electrophotographic toner may have a dielectric loss of from about 0.01 to about 0.02 or less at a frequency of $10^3$ Hz. The dielectric loss (tan δ) is represented as a dielectric loss factor (∈")/dielectric constant (∈').

When the dielectric loss (tan δ) of the electrophotographic toner is within this range, scattering or development characteristics of the electrophotographic toner may not deteriorate, and relatively stable charges may be attained during development and transferring operations.

The dielectric loss (tan δ) of the electrophotographic toner may be adjusted by controlling the distribution state of carbon black in the electrophotographic toner and controlling methods for dispersing the carbon black.

The dielectric loss (tan δ) of the electrophotographic toner may be obtained using a Wayne Kerr measurement instrument and the following equations.

$$\text{Dielectric constant}(\in') = (I\times C)/(\pi\times\text{area of electrode } S\times\in_o)$$

$$\text{Dielectric loss}(\tan\delta) = \text{Dielectric loss factor}(\in'')/\text{Dielectric constant}(\in')$$

According to another aspect of the present general inventive concept, a method of preparing the electrophotographic toner may include a primarily agglomerating step of agglomerating primary binder particles, a coloring agent, and a releasing agent to form core-layer particles, and coating surfaces of the core-layer particles with secondary binder particles to form a shell layer. As a result, the electrophotographic toner with a core/shell structure is obtained.

The thickness of the shell layer of the electrophotographic toner is not specifically limited. For example, the shell layer may have a thickness of from about 0.1 μm to about 0.5 μm.

When the thickness of the shell layer is within this range, the shell layer may be thick enough to prevent the releasing agent from being leaked from the toner surface, which could contaminate a photoreceptor, and to prevent the coloring agent from being leaked, so that the stability of charges of the electrophotographic toner is maintained.

The electrophotographic toner may include iron (Fe) and silicon (Si). The amount of Fe may be from about $1.0\times10^3$ ppm to about $1.0\times10^4$ ppm, and in some embodiments, may be from about $2.0\times10^3$ ppm to about $0.8\times10^4$ ppm, and in some other embodiments, may be from about $4.0\times10^3$ ppm to about $0.6\times10^4$ ppm. The amount of Si may be from about $1.0\times10^3$ ppm to about $5.0\times10^3$ ppm, and in some embodiments, may be from about $1.5\times10^3$ ppm to about $4.5\times10^3$ ppm, and in some other embodiments, may be from about $2.0\times10^3$ ppm to about $4.0\times10^3$ ppm.

When the amounts of Si and Fe are within these ranges, the electrophotographic toner may have improved charging characteristics, and may not contaminate the internal portions of the image forming apparatus in which such toner is used.

The electrophotographic toner may include sulfur (S), iron (Fe), and silicon (Si), wherein a [S]/[Fe] ratio is in the range of about $5.0\times10^{-4}$ to about $5.0\times10^{-2}$ and a [Si]/[Fe] ratio is in the range of about $5.0\times10^{-4}$ to about $5.0\times10^{-2}$, where [S], [Fe], and [Si] respectively denote the intensities of S, Fe and Si measured by X-ray fluorescence spectrometry.

[Fe] corresponds to the amount of Fe contained in an agglomerating agent that is used to agglomerate a latex, a colorant and a releasing agent when toner is prepared. Thus, [Fe] may affect the agglomeration degree, the particle size distribution and the particle size of agglomerated toner. The agglomerated toner may be a precursor for preparing a final toner.

[Si] corresponds to the amount of Si contained in the agglomerating agent or Si contained in silica particles that are externally added for the flowability of the toner. Thus, [Si] may affect the agglomeration properties, the particle distribution and the particle size of agglomerated toner, as [Fe] does, and may also affect the flowability of toner.

The [Si]/[Fe] ratio may be in the range of about $5.0\times10^{-4}$ to about $5.0\times10^{-2}$, and in some embodiments, may be in the range of about $8.0\times10^{-4}$ to about $3.0\times10^{-2}$, and in some other embodiments, may be in the range of about $1.0\times10^{-3}$ to about $1.0\times10^{-2}$.

When the [Si]/[Fe] ratio is within the range of about $5.0\times10^{-4}$ to about $5.0\times10^{-2}$, the flowability of the toner may be improved, and contamination of the inside of a printer due to toner may be prevented.

[S] corresponds to the amount of S contained in an S-containing compound that acts as a chain transfer agent for adjusting a latex molecular distribution when the latex is prepared. Accordingly, if [S] is high, the molecular weight of the latex may be too low and new chains may be initiated. On the other hand, if [S] is low, a chain may continuously grow and thus the molecular weight of the latex may be large.

When the [S]/[Fe] ratio is within the range of about $5.0\times10^{-4}$ to about $5.0\times10^{-2}$, the toner may have improved agglomeration characteristics and charging characteristics, an appropriate molecular weight, an appropriate particle size distribution, and an appropriate particle diameter.

The electrophotographic toner may have a volume average particle diameter of about 4.0 μm to about 9 μm, and in some embodiments, may have a volume average particle diameter of about 4.5 μm to about 8.7 μm, and in some other embodiments, may have a volume average particle diameter of about 4.5 μm to about 8.5 μm.

In general, the smaller the toner particle size, the higher the resolution and the higher the quality of an image that may be achieved. When transfer speed and cleansing force are taken into consideration, however, small toner particles may not be appropriate for all applications. Thus, the appropriate toner particle diameter is an important consideration.

The volume average particle diameter of the toner may be measured by electrical impedance analysis.

When the volume average particle diameter of the toner is greater than or equal to about 4.0 μm, it may be easier to clean a photoreceptor, mass-production yield may be improved, and no harmful effects on the human body are caused due to scattering. On the other hand, when the volume average particle diameter of the toner is equal to or less than about 9.0 μm, this may lead to uniform charging, may improve fixability of the toner, and may facilitate regulation of the toner layer with a doctor blade.

Toner particle distribution coefficients may include a volume average particle size distribution coefficient (GSDv) and a number average particle size distribution coefficient (GSDp), which may be measured as follows.

First, a toner particle size distribution is obtained from toner particle diameters measured using a particle sizing and counting analyzer, for example, the Multisizer™ III available from Beckman Coulter, Inc. of Fullerton, Calif., U.S.A. Next, the toner particle diameter distribution is then divided into predetermined particle diameter ranges (channels). Finally, with respect to the respective particle diameter ranges (channels), the cumulative volume distribution of toner particles and the cumulative number distribution of toner particles are measured. In each of the cumulative volume and number distributions, the particle size in each distribution is increased in a direction from left to right. A cumulative particle diameter at 16% of the respective cumulative distributions is defined as a volume average particle diameter D16v and a number average particle diameter D16p: a cumulative particle diameter at 50% of the respective cumulative distributions is defined as a volume average particle diameter D50v and a number average particle diameter D50p; and a cumulative particle diameter at 84% of the respective cumulative distributions is defined as a volume average particle diameter D84v and a number average particle diameter D84p.

The GSDv and the GSDp may be obtained using the fact that the GSDv is defined as $(D84v/D16v)^{0.5}$ and the GSDp is defined as $(D84p/D16p)^{0.5}$.

The GSDp may be from about 1.0 to about 1.35, and in some embodiments, may be from about 1.15 to about 1.30, and in some other embodiments, may be from about 1.20 to about 1.25. The GSDv may be from about 1.0 to about 1.3, and in some embodiments, may be from about 1.15 to about 1.27, and in some other embodiments, may be from about 1.20 to about 1.25. When each of the GSDv and GSDp is within these ranges, the electrophotographic toner may have a uniform particle diameter.

The shape of toner particles affects the characteristics of the toner. Amorphous toner may have poor transfer characteristics, poor flowability, and poor development durability due to stress between toner particles, while spherical toner particles may have poor frictional charging characteristics and poor cleaning characteristics. The wider the shape distribution of toner particles, the wider the distribution of charges, which may lead to a selection phenomenon which may deteriorate the durability of images printed at the end of toner's shelf life span.

The surface characteristics of toner also affect the characteristics of the toner. The greater the surface roughness, the more vulnerable the toner is to environmental conditions, and thus the stability of charges may be more likely to deteriorate according to environmental conditions. The greater the surface smoothness, the smaller the surface area becomes, which may have a negative effect on frictional electrification. Therefore, it is crucial to find a shape, a circularity distribution, and a surface area that may satisfy the required charging characteristics, developing characteristics, flowability, and cleaning characteristics.

The circularity of toner may be obtained using a flow particle image analyzer (e.g., the FPIA-3000 particle analyzer available from SYSMEX Corporation of Kobe, Japan), and by using the following equation:

$$\text{Circularity}=2\times(\pi\times\text{area})^{0.5}/\text{circumference}$$

The circularity may be in the range of 0 to 1, and as the circularity approaches 1, toner particle shape becomes more circular.

The electrophotographic toner may have an average circularity of from about 0.960 to about 0.985, and in some embodiments, may have an average circularity of from about 0.964 to about 0.980, and in some other embodiments, may have an average circularity of from about 0.967 to about 0.977.

When the electrophotographic toner has an average circularity of 0.960 or greater, an image may be developed on a transfer medium to have an appropriate thickness, which may reduce toner consumption. In addition, spaces between toner particles may not be so large, so that the image developed on the transfer medium may be coated with the toner at a sufficient coating rate. Relatively less stress between toner particles, compared to amorphous toner, ensures better development durability. On the other hand, when the electrophotographic toner has an average circularity of 0.985 or less, the electrophotographic toner may be unlikely to be excessively or non-uniformly supplied onto a development sleeve, thus preventing contamination of the development sleeve. Cleaning characteristics with respect to the use of a cleaning blade may also be improved, compared to when using more circular toner.

According to another aspect the present general inventive concept, methods of preparing the electrophotographic toner may include: mixing primary binder particles including two kinds of resin latexes having different weight average molecular weights, a colorant dispersion and a releasing agent dispersion together to thereby produce a mixed solution; adding an agglomerating agent to the mixed solution to thereby produce core-layer particles; and coating the core-layer particles with shell-layer particles including secondary binder particles to thereby produce toner particles, wherein the secondary binder particles are prepared by polymerizing at least one polymerizable monomer. The electrophotographic toner may include a binder including two kinds of resin having different weight average molecular weights, a colorant, and a releasing agent; have a molecular weight distribution curve, as measured by gas permeation chromatography (GPC), with a main peak in a region of from about $8.0\times10^3$ g/mol to about $4.0\times10^4$ g/mol and a shoulder starting point in a region greater than or equal to about $1.0\times10^5$ g/mol; have a weight average molecular weight of from about $5.0\times10^4$ g/mol to about $4.0\times10^5$ g/mol, and a Z-average molecular weight of from about $1.0\times10^5$ g/mol to about $6.0\times10^6$ g/mol; and have an average circularity of from about 0.960 to about 0.985 with a coefficient of variation (CV) of from about 1.5% to about 3.3%.

In the methods of preparing the electrophotographic toner, the primary binder particles may include a polymer synthesized by polymerizing at least one polymerizable monomer, or may consist exclusively of polyester, or may include a mixture thereof (hybrid). When the primary binder particles include a polymer, at least one polymerizable monomer may be polymerized together with a releasing agent, such as wax, to synthesize the polymer. Alternatively, a polymer may be used as a mixture with a releasing agent.

The primarily binder particles may include two kinds of resin latexes having different weight average molecular weights, for example, a low-molecular weight resin latex and a large-molecular weight resin latex.

The large-molecular weight resin latex may have a weight average molecular weight of from about $1.0\times10^5$ g/mol to about $5.0\times10^6$ g/mol, and in some embodiments, may have a weight average molecular weight of from about $1.5\times10^5$ g/mol to about $3.5\times10^6$ g/mol, and in some other embodiments, may have a weight average molecular weight of from about $2.0\times10^5$ g/mol to about $3.0\times10^6$ g/mol. When the weight average molecular weight of the large-molecular weight resin latex is within these ranges, a wide fusing latitude may be ensured, and durability and gloss may be improved.

A weight ratio of the low-molecular weight resin latex to the large-molecular weight resin latex may be from about 99:1 to about 70:30, and in some embodiments, may be from about 97:3 to about 80:20, and in some other embodiments, may be from about 95:5 to about 85:15.

When the weight ratio is within the range of from about 99:1 to about 70:30, the electrophotographic toner may have improved durability and hot offset characteristics, and high gloss.

The primary binder particles may be prepared using a low-molecular weight resin latex and a large-molecular weight resin latex, wherein the low-molecular weight resin latex has a molecular weight equal to or less than a critical molecular weight and is prepared so as to have a volume average diameter of from about 100 nm to about 300 nm, and the large-molecular weight resin latex is prepared using emulsification-polymerization or dispersion so as to have a volume average diameter of from about 100 nm to about 300 nm.

When the volume average diameters of the low-molecular weight resin latex and the large-molecular weight resin latex are from about 100 nm to about 300 nm, it may be easy to control the degree of agglomeration of the toner, which ensures a final toner with desired particle diameters is obtained.

The low-molecular weight resin latex may have a weight average molecular weight of from about $1.3\times10^4$ g/mol to about $3.0\times10^4$ g/mol, and in some embodiments, may have a weight average molecular weight of from about $1.5\times10^4$ g/mol to about $2.8\times10^4$ g/mol, and in some other embodiments, may have a weight average molecular weight of from about $1.7\times10^4$ g/mol to about $2.5\times10^4$ g/mol. When the weight average molecular weight of the low-molecular weight resin latex is within these ranges, the electrophotographic toner may have an improved strength, and better durability and fixability.

The polymerizable monomer used herein may include, but is not limited to, at least one selected from the group consisting of styrene-based monomers such as styrene, vinyltoluene, α-methylstyrene, and the like; acrylic acids, methacrylic acids; derivatives of (meth)acrylic acid such as methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, dimethylaminoethyl methacrylate, acrylonirile, methacrylonirile, acrylamide, methacrylamide, and the like; ethylenically unsaturated monoolefines such as ethylene, propylene, butylene, and the like; halogenated vinyls such as vinyl chloride, vinylidene chloride, vinyl fluoride, and the like; vinyl esters such as vinyl acetate, vinyl propionate, and the like; vinyl ethers such as vinylmethylether, vinylethylether, and the like; vinyl ketones such as vinylmethylketone, methylisoprophenylketone, and the like; and a nitrogen-containing vinyl compound such as 2-vinylpyridine, 4-vinylpyridine, N-vinylpyrrolidone, and the like.

When the primary latex particles are manufactured, a polymerization initiator and a chain transfer agent may be further used to efficiently perform the polymerization process.

Examples of the polymerization initiator include, but are not limited to, persulfates such as potassium persulfate, ammonium persulfate, and the like; azo compounds such as 4,4-azobis(4-cyano valeric acid), dimethyl-2,2'-azobis(2-methylpropionate), 2,2-azobis(2-amidinopropane)dihydrochloride, 2,2-azobis-2-methyl-N-1,1-bis(hydroxymethyl)-2-hydroxyethylpropioamide, 2,2'-azobis(2,4-dimethylvaleronirile), 2,2'-azobisisobutyronirile, 1,1'-azobis(1-cyclohexancarbonirile), and the like; and peroxides such as methylethylperoxide, di-t-butylperoxide, acetylperoxide, dikumylperoxide, lauroylperoxide, benzoylperoxide, t-butylperoxy-2-ethylhexanoate, di-isopropylperoxydicarbonate, di-t-butylperoxyisophthalate, and the like. Oxidation-reduction initiators prepared by combining these polymerization initiators and reductants may also be used as the polymerization initiator.

A chain transfer agent refers to a material that changes the type of a chain carrier during a chain reaction, or a material that significantly reduces the activity of a new chain compared to that of existing chains. As a result of using the chain transfer agent, the degree of polymerization of polymerizable monomers may be reduced, and the reaction for a new chain may be initiated. As a result of using a chain transfer agent, the molecular weight distributions of toner may also be controlled.

The amount of the chain transfer agent may be, for example, in the range of about 0.1 to about 5 parts by weight, about 0.2 to about 3 parts by weight, or about 0.5 to about 2.0 parts by weight, based on 100 parts by weight of the at least one polymerizable monomer. If the amount of the chain transfer agent is less than about 0.1 parts by weight, the molecular weight of the primary binder may be too high, and agglomeration effects may deteriorate. If the amount of the chain transfer agent exceeds about 5 parts by weight, the molecular weight of the binder may be too low, and fixing characteristics may deteriorate.

Examples of the chain transfer agent include, but are not limited to, sulfur-containing compounds such as dodecanethiol, thioglycolic acid, thioacetic acid, mercaptoethanol, and the like; phosphorous acid compounds such as a phosphorous acid, sodium phosphorous acid, and the like; hypophosphorous acid compounds such as a hypophosphorous acid, a sodium hypophosphorous acid, and the like; and alcohols such as methyl alcohol, ethyl alcohol, isopropyl alcohol, n-butyl alcohol, and the like.

The primary binder particles may further include a charge control agent. The charge control agent may be a negatively charged charge control agent or a positively charged charge control agent. Examples of the negatively charged charge control agent include, but are not limited to, organic metal complexes such as a chromium containing azo complex, a mono-azo metal complex, chelate compounds, and the like; metal-containing salicylic acid compounds wherein the metal may be chromium, iron, zinc, or the like; and organic metal complexes such as aromatic hydroxycarboxylic acids, aromatic dicarboxylic acid, and the like. The positively charged charge control agent may be a modified product, such as nigrosine or a fatty acid metal salt thereof; or an onium salt including, but not limited to, a quaternary ammonium salt such as tributylammonium 1-hydroxy-4-naphthosulfonate, tetrabutylammonium tetrafluoro borate, and the like. These charge control agents may be used alone or in a combination of at least two thereof. The charge control agent may operate to stably support toner on a development roller with an electrostatic force. Thus, by using the charge control agent, stable and high-speed charging may be ensured.

The primary binder particles obtained may be mixed with the colorant dispersion and the releasing agent dispersion to prepare a mixed solution. The colorant dispersion may be obtained by uniformly dispersing a composition including a colorant, such as a black colorant, a cyan colorant, a magenta colorant, or a yellow colorant, and an emulsifier by using an ultrasonic homogenizer or a micro fluidizer.

Among colorants used to prepare a colorant dispersion, the black colorant may be carbon black or aniline black. For color toner, at least one colorant is selected from the group consisting of cyan colorant, magenta colorant, and yellow colorant, which may be further used in addition to the black colorant.

The yellow colorant may include, but is not limited to, a condensed nitrogen compound, an isoindolinone compound, an anthraquinone compound, an azo metal complex, an alkyl imide compound, and the like. Examples of the yellow colorant include, but are not limited to, C.I. pigment yellows 12, 13, 14, 17, 62, 74, 83, 93, 94, 95, 109, 110, 111, 128, 129, 147, 168, 180, and the like.

Examples of the magenta colorant include, but are not limited to, condensed nitrogen compounds, anthraquine compounds, quinacridone compounds, base dye lake compounds, naphthol compounds, benzo imidazole compounds, thioindigo compounds, perylene compounds, and the like. Specifically, examples of the magenta colorant include, but are not limited to, C.I. pigment reds 2, 3, 5, 6, 7, 23, 48:2, 48:3, 48:4, 57:1, 81:1, 122, 144, 146, 166, 169, 177, 184, 185, 202, 206, 220, 221, 254, and the like.

Examples of the cyan colorant include, but are not limited to, copper phthalocyanine compounds and derivatives thereof, anthraquinone compounds, base dye lake compounds, and the like. Specifically, examples of the cyan colorant include, but are not limited to, C.I. pigment blues 1, 7, 15, 15:1, 15:2, 15:3, 15:4, 60, 62, 66, and the like.

These colorants may be used alone or in a combination of at least two thereof, and may be selected in consideration of color, chromaticity, brightness, weather resistance, or dispersibility in toner.

The amount of the colorant used to prepare the colorant dispersion may be in the range of about 0.5 to about 15 parts by weight, about 1 to about 12 parts by weight, or about 2 to about 10 parts by weight, based on 100 parts by weight of toner. If the amount of the colorant is less than about 0.5 parts by weight, a coloring effect may be insufficient. If the amount of the colorant exceeds about 15 parts by weight, the manufacturing costs of the toner may be increased, and a sufficient frictional electrification quantity may not be obtained.

The emulsifier used to prepare the colorant dispersion may be any emulsifier known to those of ordinary skill in the art. For example, the emulsifier may be an anionic reactive emulsifier, a non-ionic reactive emulsifier, or a mixture thereof. The anionic reactive emulsifier may be HS-10 (Dai-Ichi Kogyo Seiyaku Co., Ltd.) or DOWFAX 2A1 (The Dow Chemical Company). The non-ionic reactive emulsifier may be RN-10 (Dai-Ichi Kogyo Seiyaku Co., Ltd.).

The releasing agent dispersion used in the method of preparing the electrophotographic toner may include a releasing agent, water, or an emulsifier.

The releasing agent enables toner to be fixed to a final-image receptor at a low fixing temperature and to have excellent final image durability and resistance to abrasion. Thus, characteristics of toner are very dependent on the type and amount of the releasing agent.

Examples of suitable releasing agents include, but are not limited to, polyethylene-based wax, polypropylene-based wax, silicon wax, paraffin-based, ester-based wax, carnauba wax, metallocene wax, and the like. The releasing agent may have a melting point of about 50° C. to about 150° C. The releasing agent may be physically attached to toner particles, but not covalently bonded with toner particles, which enables toner to be fixed to the final-image receptor at a low temperature, and thus provides a final image that has excellent durability and resistance to abrasion.

The amount of the releasing agent may be in the range of about 1 to about 20 parts by weight, about 2 to about 16 parts by weight, or about 3 to about 12 parts by weight, based on 100 parts by weight of the toner. If the amount of the releasing agent is less than about 1 part by weight, the low-temperature fixing characteristics of the toner may be poor, and the fixing temperature range may become narrow. If the amount of the releasing agent exceeds about 20 parts by weight, preservation characteristics may deteriorate, and costs may be increased.

The releasing agent may be an ester group-containing wax. Examples of the ester group-containing wax include a mixture of an ester-based wax and a non-ester based wax; and an ester group-containing wax prepared by adding an ester group to a non-ester based wax.

Since an ester group has high affinity with the binder latex component of the electrophotographic toner, the wax may be uniformly distributed among toner particles, and may effectively function. The non-ester based wax has a releasing effect on the binder latex component, and may suppress excessive plasticizing reactions, which occur when an ester-based wax is exclusively used. The toner may retain satisfactory development characteristics for a long period of time.

Examples of the ester-based wax include, but are not limited to, esters of monovalent to pentavalent alcohols and C15-C30 fatty acids such as behenic acid behenyl, staric acid stearyl, stearic acid ester of pentaeritritol, montanic acid glyceride, and the like. If an alcohol component constituting the ester is a monovalent alcohol, it may include 10 to 30 carbon atoms. If an alcohol component constituting the ester is a polyvalent alcohol, it may include 3 to 10 carbon atoms.

The non-ester based wax may be polymethylene-based wax or paraffin-based wax.

Examples of the ester group-containing wax include, but are not limited to, a mixture of a paraffin-based wax and an ester-based wax; and an ester group-containing paraffin-based wax. Examples of the ester group-containing wax may also include P-280, P-318, and P-319 (available from Chukyo Yushi Co., Ltd. of Nagoya, Japan).

If the releasing agent is a mixture of a paraffin-based wax and an ester-based wax, the amount of the ester-based wax in the releasing agent may be, for example, in the range of about 5 to about 35 wt %, about 3 to about 36 wt %, or about 9 to about 33 wt %, based on the total weight of the releasing agent.

When the amount of the ester-based wax is greater than or equal to about 1 wt % based on the total weight of the releasing agent, the compatibility of the ester-based wax with the binder latex may be sufficiently maintained. When the amount of the ester-based wax is less than or equal to about 35 wt % based on the total weight of the releasing agent, the toner may have appropriate plasticizing characteristics, and may retain satisfactory development characteristics for a long period of time. Anti-offset characteristics at high temperatures and gloss may also be improved.

Like the emulsifier used in the colorant dispersion, any emulsifier that is used in the art may be used as an emulsifier for the releasing agent dispersion. Examples of the emulsifier available for the releasing agent dispersion include, but are not limited to, an anionic reactive emulsifier, a non-ionic reactive emulsifier, and the like, and mixtures thereof. The anionic reactive emulsifier may be HS-10 (Dai-Ichi Kogyo Seiyaku Co., Ltd.) or DOWFAX 2A1 (The Dow Chemical Company). The non-ionic reactive emulsifier may be RN-10 (Dai-Ichi Kogyo Seiyaku Co., Ltd.).

The molecular weight, glass transition temperature (Tg) and the rheological characteristics of the primary binder particles obtained by the methods disclosed herein may be appropriately controlled in such a way that toner may be fixed at low temperature.

The primary binder particles, the colorant dispersion and the releasing agent dispersion are mixed to obtain a mixed solution. An agglomerating agent solution is added to the mixed solution to prepare an agglomerated toner. For example, the primary binder particles, the colorant dispersion, and the releasing agent dispersion are mixed, and then the agglomerating agent solution is added at a pH of about 1 to about 2.0, thereby preparing core-layer particles having a volume average particle diameter of 2.5 μm or less. The secondary binder particles are added, and the pH of the system is adjusted to about 6 to about 8 and left until the particle size of the mixture is maintained constant for a predetermined period of time. The temperature of the mixture is raised to 90 to 98° C. and the pH is lowered to 5 to 6 in order to coalesce the mixture into toner particles.

Examples of the agglomerating agent include, but are not limited to, NaCl, $MgCl_2$, $MgCl_2.8H_2O$, ferrous sulfate, ferric sulfate, ferric chloride, calcium hydroxide, calcium carbonate, Si- and Fe-containing metal salts, and the like.

The amount of the agglomerating agent may be, for example, in the range of about 0.1 to about 10 parts by weight, about 0.5 to about 8 parts by weight, or about 1 to about 6 parts by weight, based on 100 parts by weight of the primary binder particles. If the amount of the agglomerating agent is less than 0.1 parts by weight, agglomeration effects may deteriorate. If the amount of the agglomerating agent exceeds 10 parts by weight, charging characteristics of the toner may deteriorate, and the particle size distribution may become non-uniform.

In an embodiment of the present inventive concept, the electrophotographic toner may be prepared by using a Si- and Fe-containing metal salt as an agglomerating agent. In the electrophotographic toner, the amount of Si and Fe may be, for example, in the range of about 3 to about 30,000 ppm, about 30 to about 25,000 ppm, or about 300 to about 20,000 ppm. If the amount of Si and Fe is less than 3 ppm, the effect of the addition of Si and Fe may be negligible. If the amount of Si and Fe exceeds 30,000 ppm, charging characteristics of the toner may deteriorate, the inside of the printer may be contaminated.

The Si- and Fe-containing metal salt may include, for example, polysilicate iron. In particular, due to the ionic strength increased by the addition of the Si and Fe-containing metal salt, and particle-to-particle collisions, the size of the toner may be increased. The Si- and Fe-containing metal salt may be polysilicate iron. Examples of the Si- and Fe-containing metal include, but are not limited to, PSI-025, PSI-050, PSI-075, PSI-100, PSI-200, and PSI-300, which are products manufactured by Suido Kiko Co. Table 1 shows the physical properties and compositions of PSI-025, PSI-050, PSI-075, PSI-100, PSI-200, and PSI-300.

TABLE 1

| Type | | PSI-025 | PSI-050 | PSI-085 | PSI-100 | PSI-200 | PSI-300 |
|---|---|---|---|---|---|---|---|
| Si/Fe Mol ratio | | 0.25 | 0.5 | 0.85 | 1 | 2 | 3 |
| Concentration of main component | Fe (wt %) | 5.0 | 3.5 | 2.5 | 2.0 | 1.0 | 0.7 |
| | $SiO_2$ (wt %) | 1.4 | 1.9 | 2.0 | | 2.2 | |
| pH (1 w/v %) | | | | 2-3 | | | |

TABLE 1-continued

| Type | PSI-025 | PSI-050 | PSI-085 | PSI-100 | PSI-200 | PSI-300 |
|---|---|---|---|---|---|---|
| Specific gravity (20° C.) | 1.14 | 1.13 | 1.09 | 1.08 | 1.06 | 1.04 |
| Viscosity (mPa · S) | 2.0 or greater | | | | | |
| Average molecular weight (Dalton) | 500,000 | | | | | |
| Appearance | transparent, yellowish brown liquid | | | | | |

By using the Si- and Fe-containing metal salt as an agglomerating agent in preparing the electrophotographic toner, the particle size of the toner may be reduced, and the particle shape may also be controllable.

A solution of the agglomerating agent may be prepared by adding the agglomerating agent to an aqueous acid solution, such as a nitric acid. The agglomerating agent solution may have a pH of 2.0 or less, and in some embodiments, may have a pH of from about 0.1 to about 2.0, and in some other embodiments, may have a pH of from about 0.3 to about 1.8, and in some other embodiments, may have a pH of from about 0.5 to about 1.6. If the pH of the agglomerating agent solution is less than 0.1, the agglomerating acid solution may be too acidic to be handled safely. If the pH exceeds 2.0, Fe contained in the agglomerating agent may not effectively eliminate an odor of the chain transfer agent, i.e., a sulfur-containing compound, used to prepare the binder latex, and the agglomeration effects may also deteriorate.

The secondary binder particles may be obtained by polymerizing at least one polymerizable monomer. The polymerization process may be an emulsion polymerization distribution process to produce secondary binder particles having a size of about 1 μm or less, for example, in the range of about 100 to about 300 nm. The secondary binder particles may include a releasing agent, which may be incorporated into the secondary binder particles in the polymerization process.

In particular, in the method of preparing the electrophotographic toner, the step of coating of the core-layer particles with the shell-layer particles to provide toner particles may include: a) agglomerating the core-layer particles and the shell-layer particles at a temperature at which the core-layer particles and the shell-layer particles have a shear storage modulus (G') of about $1.0\times10^8$ to about $1.0\times10^9$ Pa; b) stopping the agglomerating when the average particle diameter of the particles obtained in operation a) reaches about 70% to about 100% of the average particle diameter of the final toner particles; and fusing and unifying the particles obtained in operation b) at a temperature at which the particles obtained in operation b) have a shear storage modulus (G') of about $1.0\times10^4$ to about $1.0\times10^9$ Pa.

The agglomerating of the core-layer particles and the shell-layer particles is a physical agglomeration process. This process may be performed at a temperature at which the core-layer particles and the shell-layer particles have a shear storage modulus (G') of about $1.0\times10^8$ to about $1.0\times10^9$ Pa in order to prevent the core-layer particles and the shell-layer particles from being fused earlier than expected. This may be advantageous in controlling the particle size distribution of toner.

The fusing and unifying of the particles obtained in operation b) may be performed by heating the particles at a temperature at which the particles have a shear storage modulus (G') of about $1.0\times10^4$ to about $1.0\times10^9$ Pa, i.e., a temperature about 10° C. to about 30° C. higher than or equal to the melting point of the particles obtained in operation b).

After the secondary binder particles, which constitute the shell-layer, are added to the core-layer particles, the pH of the system is adjusted to be about 6 to about 9 and is maintained until a particle size of the mixture is maintained constant for a predetermined period of time. The temperature is raised to about 90 to about 98° C., and the pH is lowered to be about 5 to about 7 in order to unify the mixture into the toner particles.

Tertiary binder particles prepared by polymerizing the at least one polymerizable monomer described above may be further coated on the toner particles.

By forming the shell layer from the secondary binder particles, or the secondary and tertiary binder particles, the toner may have higher durability and excellent preservation characteristics during shipping and handling. A polymerization inhibitor may be further added to prevent formation of new binder particles. In addition, a mixed monomer solution may be coated on the toner in starved-feeding conditions to ensure coating quality.

The obtained toner particles are then filtered, separated and dried. An external additive is added to the dried toner particles. The amount of charge applied thereto may be controlled, thereby obtaining final dry toner.

Examples of the external additive include Si-containing particles and Ti-containing particles.

The Si-containing particles may include large-diameter Si-containing particles having a volume average particle diameter of about 30 nm to about 100 nm and small-diameter Si-containing particles having a volume average particle diameter of about 5 nm to about 20 nm. An example of the Si-containing particles includes, but is not limited to, silica.

The small-diameter Si-containing particles and the large-diameter Si-containing particles are added to negatively charge toner and to provide flowability. The small-diameter Si-containing particles and the large-diameter Si-containing particles may be prepared by a dry process using halogenated Si compounds or by a wet process in which the particles are precipitated in a liquid solution of Si compounds.

The large-diameter Si-containing particles may have a volume average particle diameter of about 30 nm to about 100 nm and may facilitate separation between individual toner particles or between a toner particle and a surface. The small-diameter Si-containing particles may have a volume average particle diameter of about 5 nm to about 20 nm and may provide toner with flowability.

The amount of the large-diameter Si-containing particles may be, for example, in the range of about 0.1 to about 3.5 parts by weight, about 0.5 to about 3.0 parts by weight, or about 1.0 to about 2.5 parts by weight, based on 100 parts by weight of mother toner particles. When the amount of the large-diameter Si-containing particles is within the range of about 0.1 to about 3.5 parts by weight, problems, such as a reduction in fixability, overcharging, contamination, filming or the like, may be prevented.

The amount of the small-diameter Si-containing particles may be, for example, in the range of about 0.1 to about 2.0 parts by weight, about 0.3 to about 1.5 parts by weight, or about 0.5 to about 1.0 part by weight, based on 100 parts by weight of mother toner particles. When the amount of the small-diameter Si-containing particles is within the range of about 0.1 to about 2.0 parts by weight, fixability may be improved, and overcharging and poor cleaning may be prevented.

An example of the Ti-containing particles includes, but is not limited to, titanium dioxide.

The Ti-containing particles increase the amount of charges and are also environmentally friendly. In particular, a charge-up of toner in low-temperature, low-humidity conditions and a charge-down of toner in high-temperature, high-humidity conditions may be prevented. The Ti-containing particles may improve flowability of toner and may maintain a high transfer efficiency even after a large number of printing operations have been performed. The Ti-containing particles may have a volume average particle diameter of about 10 nm to about 200 nm. The amount of the Ti-containing particles may be in the range of about 0.1 to about 2.0 parts by weight, about 0.3 to about 1.5 parts by weight, or about 0.5 to about 1.0 parts by weight, based on 100 parts by weight of mother toner particles. When the amount of the Ti-containing particles is within the range of about 0.1 to about 2.0 parts by weight, charging properties may be maintained regardless of environmental condition changes, and image contamination and a reduction in charge amount may be prevented.

According to another aspect of the present general inventive concept, an imaging method may include: attaching toner to a surface of a photoreceptor on which an electrostatic latent image is formed, to form a visible image; and transferring the visible image onto a transfer medium. The toner may include a binder including two kinds of resin having different weight average molecular weights, a colorant, and a releasing agent; have a molecular weight distribution curve, as measured by gas permeation chromatography (GPC), with a main peak in a region of from about $8.0\times10^3$ g/mol to about $4.0\times10^4$ g/mol and a shoulder starting point in a region greater than or equal to about $1.0\times10^5$ g/mol; have a weight average molecular weight of from about $5.0\times10^4$ g/mol to about $4.0\times10^5$ g/mol, and a Z-average molecular weight of from about $1.0\times10^5$ g/mol to about $6.0\times10^6$ g/mol; and have an average circularity of from about 0.960 to about 0.985 with a coefficient of variation (CV) of from about 1.5% to about 3.3%.

Typical electrophotographic imaging processes include a series of imaging steps on a receptor, including charging, exposing to light, developing, transferring, fixing, cleaning, and erasing processes.

In the charging process, a surface of a photoreceptor is charged with negative or positive charges, whichever is desired, by a corona discharge or a charge roller. In the exposing to light process, the charged surface of the photoreceptor is selectively discharged in an image-wise manner using a laser scanner or an array of diodes in order to form a latent image corresponding to a final visible image to be formed on a final-image receptor, such as, for example, a sheet of paper. Electromagnetic radiation that may be referred to as "light radiation" includes, but is not limited to, infrared radiation, visible light radiation, and ultraviolet radiation.

In the developing process, toner particles having appropriate polarity generally contact the latent image on the photoreceptor. An electrically-biased developer having the same potential polarity as the polarity of the toner is used. The toner particles move to the photoreceptor and are selectively attached to the latent image by an electrostatic force to form a toner image on the photoreceptor.

In the transferring process, the toner image is transferred to the final-image receptor from the photoreceptor. An intermediate transfer element is often used to aid subsequent transfer of the toner image from the photoreceptor, for example, to the final-image receptor.

In the fixing process, the toner image on the final-image receptor is heated to soften or melt toner particles, thereby fixing the toner image to the final-image receptor. An alternative fixing method may involve fixing the toner image to the final-image receptor under high pressure with or without the application of heat.

In the cleaning process, residual toner remaining on the photoreceptor is removed.

Finally, in the erasing process, the photoreceptor is exposed to light having a predetermined wavelength to substantially uniformly reduce the amount of charges on the photoreceptor, thereby removing the residue of the original latent image from the photoreceptor. As a result, the photoreceptor is ready for a next imaging cycle.

According to another aspect of the present general inventive concept, a toner supply unit may include: a toner tank in which toner may be stored; a supplying part protruding from an inner surface of the toner tank to externally supply toner from the toner tank; and a toner-agitating member rotatably disposed inside the toner tank to agitate toner in almost the entire inner space of the toner tank including a space above a top surface of the supplying part. The toner may include a binder including two kinds of resin having different weight average molecular weights, a colorant, and a releasing agent; have a molecular weight distribution curve, as measured by gas permeation chromatography (GPC), with a main peak in a region of from about $8.0\times10^3$ g/mol to about $4.0\times10^4$ g/mol and a shoulder starting point in a region greater than or equal to about $1.0\times10^5$ g/mol; have a weight average molecular weight of from about $5.0\times10^4$ g/mol to about $4.0\times10^5$ g/mol, and a Z-average molecular weight of from about $1.0\times10^5$ g/mol to about $6.0\times10^6$ g/mol; and have an average circularity of from about 0.960 to about 0.985 with a coefficient of variation (CV) of from about 1.5% to about 3.3.

FIG. 1 is a view of a toner supplying unit 100, according to an embodiment of the present general inventive concept.

The toner supplying unit 100 may include a toner tank 101, a supplying part 103, a toner-conveying member 105 and a toner-agitating member 110.

The toner tank 101 is configured to store therein a predetermined amount of toner, and may have a substantially hollow cylindrical shape.

The supplying part 103 may be disposed on an inner bottom surface of the toner tank 101, and may be configured to externally discharge toner contained in the toner tank 101. For example, the supplying part 103 may protrude from the bottom of the toner tank 101 to have a pillar shape with a semi-circular cross-section. The supplying part 103 may include a toner outlet (not shown) in an outer side, through which the toner may be discharged.

The toner-conveying member 105 may be disposed at a side of the supplying part 103 on the inner bottom surface of the toner tank 101. The toner-conveying member 105 may have, for example, a coil spring shape. An end of the toner-conveying member 105 may extend inside the supplying part 103 so that toner in the toner tank 101 is conveyed into the supplying part 103 as the toner-conveying member 105 rotates. Toner conveyed by the toner-conveying member 105 may be externally discharged through the toner outlet of the supplying part 103.

The toner-agitating member 110 is rotatably disposed inside the toner tank 101 and forces toner in the toner tank 101 to move in a radial direction. For example, when the toner-agitating member 110 rotates in the middle of the toner tank 101, toner in the toner tank 101 is agitated to prevent the toner from solidifying. As a result, the toner moves down to the bottom of the toner tank 101 due to gravity. The toner-agitating member 110 includes a rotation shaft 112 and a toner-agitating film 120. The rotation shaft 112 is rotatably disposed in the middle of the toner tank 101, and may have a driving gear (not shown) that may be coaxially coupled with an end of the rotation shaft 112 protruding from a side of the toner tank 101. The rotation of the driving gear causes the rotation shaft 112 to rotate. The rotation shaft 112 may also have a support plate 114 to help fix a toner-agitating film 120 to the rotation shaft 112. The support plate 114 may be formed to be substantially symmetric about the rotation shaft 112. The toner-agitating film 120 has a width corresponding to the inner length of the toner tank 101. The toner-agitating film 120 may be elastically deformable in consideration of the shape of a projection inside the toner tank 101, i.e., the supply part 103.

The toner-agitating film 120 may include a first agitating part 121 and a second agitating part 122 formed by cutting an end of the toner-agitating film 120 toward the rotation shaft 112 by a predetermined length.

According to another aspect of the present general inventive concept, an imaging apparatus may include a photoreceptor, an imaging unit for forming an electrostatic latent image on the photoreceptor, a unit for containing toner, a toner supplying unit for supplying toner to the photoreceptor so as to develop the electrostatic latent image into a toner image on the photoreceptor, and a toner transfer unit for transferring the toner image formed on the photoreceptor to a transfer medium. The toner may include a binder including two kinds of resin having different weight average molecular weights, a colorant, and a releasing agent; have a molecular weight distribution curve, as measured by gas permeation chromatography (GPC), with a main peak in a region of from about $8.0\times10^3$ g/mol to about $4.0\times10^4$ g/mol and a shoulder starting point in a region greater than or equal to about $1.0\times10^5$ g/mol; have a weight average molecular weight of from about $5.0\times10^4$ g/mol to about $4.0\times10^5$ g/mol, and a Z-average molecular weight of from about $1.0\times10^5$ g/mol to about $6.0\times10^6$ g/mol; and have an average circularity of from about 0.960 to about 0.985 with a coefficient of variation (CV) of from about 1.5% to about 3.3%.

Figure 2:
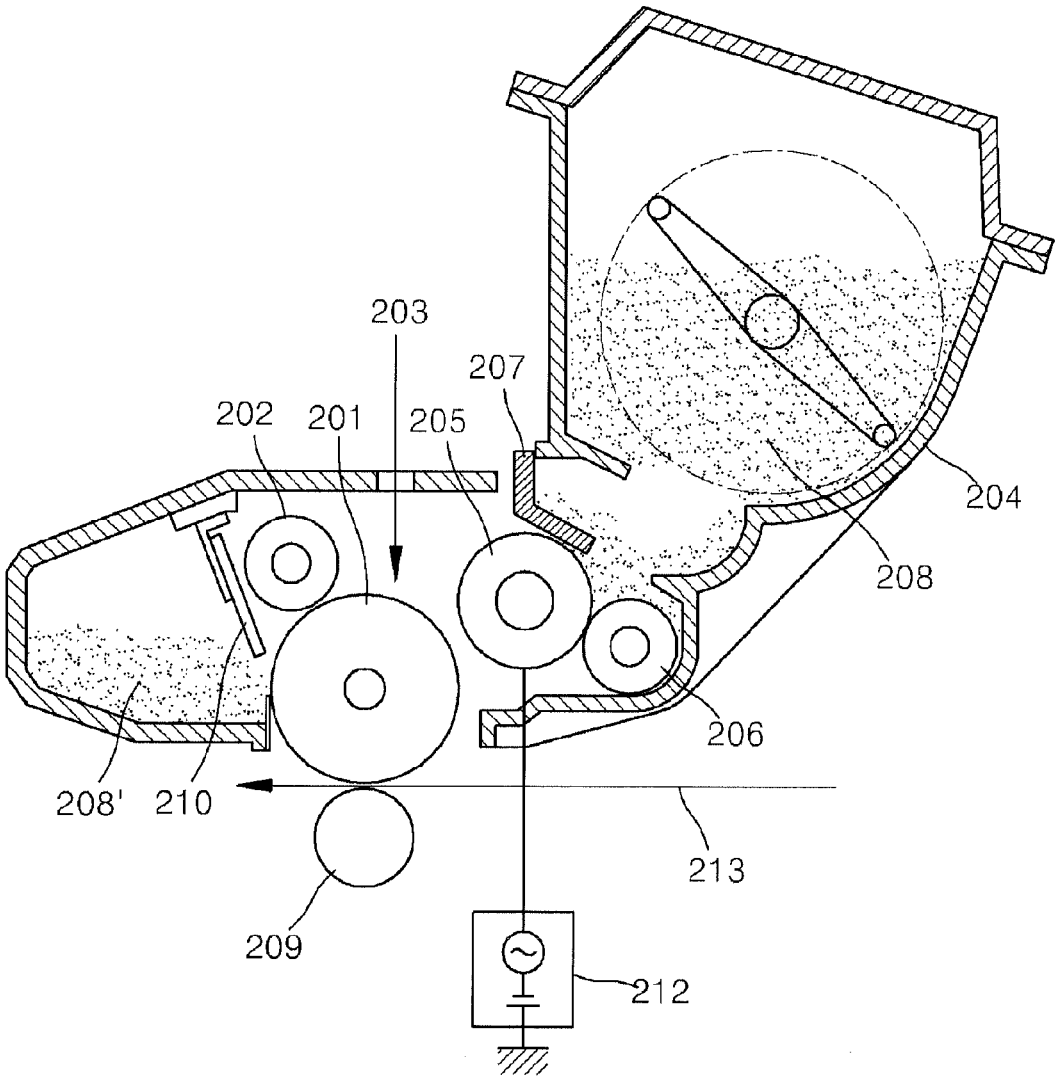
FIG. 2 is a schematic view of an imaging apparatus utilizing toner, according to an embodiment of the present general inventive concept.

FIG. 2 is a schematic view of a non-contact development type imaging apparatus utilizing the toner according to the present disclosure.

A developer 208 of the developing device 204, which is a nonmagnetic one-component developer, is supplied to a developing roller 205 by a supply roller 206 formed of an elastic material, such as polyurethane foam or sponge. The developer 208 supplied to the developing roller 205 reaches a contact portion between a developer-regulating blade 207 and the developing roller 205 as the developing roller 205 rotates. The developer-regulating blade 207 may be formed of an elastic material, such as metal or rubber. When the developer 208 passes through the contact portion between the developer-regulating blade 207 and the developing roller 205, the developer 208 is regulated to form a thin layer having a uniform thickness and is sufficiently charged. The developer 208 formed into a thin layer is transferred to a development region of a photoreceptor 201, which functions as an image carrier, by the developing roller 205, wherein an electrostatic latent image is developed in the development region. The electrostatic latent image may be formed by scanning light 203 onto the photoreceptor 201.

The developing roller 205 is arranged to face the photoreceptor 201 while being spaced apart from the photoreceptor 201 by a predetermined distance. The developing roller 205 and the photoreceptor 201 may rotate in opposite directions with respect to each other. For example, the developing roller 205 may rotate in a counterclockwise direction while the photoreceptor 201 may rotate in a clockwise direction.

The developer 208 transferred to the development region of the photoreceptor 201 develops the electrostatic latent image formed on the photoreceptor 201 into a toner image, wherein the electrostatic latent image is formed by an electric force generated due to a potential difference between a direct current (DC) biased alternating current (AC) voltage 212 applied to the developing roller 205 and a latent potential of the photoreceptor 201 charged by a charging unit 202.

The developer 208 developed on the photoreceptor 201 reaches the position of a transfer unit 209 according to a rotation direction of the photoreceptor 201. The developer 208 developed on the photoreceptor 201 is transferred to a print medium 213 by the transfer unit 209 having a roller shape and to which a high voltage having a polarity opposite to the developer 208 is applied, or by corona discharging, while the print medium 213 passes between the photoreceptor 201 and the transfer unit 209.

While the image transferred to the print medium 213 passes through a high-temperature and high-pressure fusing device (not shown), the developer 208 is fused to the print medium 213, thereby fixing the image. A non-developed, residual developer 208' on the developing roller 205 is collected by the supply roller 206 contacting the developing roller 205, and a non-developed, residual developer 208' on the photoreceptor 201 is collected by a cleaning blade 210. The above-described processes may be repeated to form subsequent images.

Hereinafter, one or more embodiments of the present disclosure will be described in more detail with reference to the following examples. These examples are not intended to limit the scope of the one or more embodiments of the present disclosure.

Preparation Example 1

Synthesis of Low-Molecular Weight Resin Latex (L-LTX)

A polymerizable monomer mixed solution (825 g of styrene and 175 g of n-butyl acrylate), 30 g of β-carboxyethylacrylate (Sipomer, Rhodia), and 17 g of 1-dodecanethiol as a chain transfer agent (CTA) were added to a 3 L beaker, and 418 g of a 2 wt % aqueous solution of sodium dodecyl sulfate (Aldrich) as an emulsifier was added to the mixture and stirred to prepare a polymerizable monomer emulsion.

Separately, 16 g of ammonium persulfate (APS) as an initiator and 696 g of a 0.4% aqueous solution of sodium dodecyl sulfate (Aldrich) as an emulsifier were added to a 3 L double-jacketed reactor heated to a temperature of 75° C. While stirring this mixture, the polymerizable monomer emulsion prepared above was slowly dropwise added into the mixture for two hours or longer. The mixture was reacted at a reaction temperature for 8 hours to obtain primary latex particles. The particle size of the primary latex particles was measured by light scattering (Horiba 910). The average particle size was in the range of about 180 to about 250 nm. The solid content of the primary latex particles, measured using a loss-on-drying method, was about 42%. The weight average molecular weight (Mw) of the latex (L-LTX), measured as a weight average molecular weight of a tetrahydrofuran (THF)-soluble component using gel permeation chromatography (GPC), was 25,000 g/mol. The glass transition temperature of the primary latex particles, measured using a differential scanning calorimeter (DSC) (PerkinElmer) by scanning twice at a temperature increase rate of 10° C./min, was about 62° C.

Preparation Example 2

Synthesis of High-Molecular Weight Resin Latex (H-LTX)

A polymerizable monomer mixed solution (685 g of styrene and 315 g of n-butyl acrylate), 30 g of β-carboxyethylacrylate (Sipomer, Rhodia), and 418 g of a 2 wt % aqueous solution of sodium dodecyl sulfate (Aldrich) as an emulsifier were added to a 3 L beaker and stirred to prepare a polymerizable monomer emulsion.

Separately, 5 g of ammonium persulfate (APS) as an initiator and 696 g of a 0.4% aqueous solution of sodium dodecyl sulfate (Aldrich) as an emulsifier were added to a 3 L double-jacketed reactor heated to a temperature of 60° C. While stirring this mixture, the polymerizable monomer emulsion prepared above was slowly dropwise added into the mixture for three hours or longer. The mixture was reacted at a reaction temperature for 8 hours to obtain primary latex particles. The particle size of the primary latex particles was measured by light scattering (Horiba 910). The average particle size was in the range of about 180 to about 250 nm. The solid content of the primary latex particles, measured using a loss-on-drying method, was about 42%. The weight average molecular weight (Mw) of the latex (H-LTX), measured as a weight average molecular weight of a tetrahydrofuran (THF)-soluble component using gel permeation chromatography (GPC), was 250,000 g/mol. The glass transition temperature of the primary latex particles, measured using a differential scanning calorimeter (DSC) (PerkinElmer) by scanning twice at a temperature increase rate of 10° C./min, was about 53° C.

Preparation Example 3

Preparation of Colorant Dispersion 10 g of sodium dodecyl sulfate as an anionic reactive emulsifier (Aldrich) and 60 g of carbon black colorant (REGAL 330, Cabot) were loaded into a milling bath, and 400 g of glass beads having a diameter of 0.8 to 1 mm was then added and milled at room temperature to prepare a colorant dispersion. A homogenizer used in this experiment was an ultrasonic waves homogenizer (Sonic and materials, VCX750). The particle size of the colorant dispersion, measured by light scattering (Horiba 910), was in the range of about 180 nm to about 200 nm. The solid content of the colorant dispersion was about 18.5%.

Preparation of Electrophotographic Toner

Example 1

Preparation of Toner 3,000 g of deionized water, 700 g of a mixed solution of the resin latexes obtained as primary binder particles in Preparation Examples 1 and 2 (95% by weight of L-LTX and 5% by weight of H-LTX), 250 g of the carbon black colorant dispersion obtained in Preparation Example 3, and 237 g of a releasing agent dispersion P-419 (30.5% of solid content, 20-30% of paraffin wax, 10-20% of synthetic ester wax, 60-70% of water, a viscosity of 13 mPa·s at 25° C., and a melting point of 89-91° C.; available from Chukyo Yushi Co., Ltd) were mixed in a 7 L reactor, and 364 g of nitric acid (0.3 mol), and 182 g of PSI-100 (available from Suido Kiko Co.) as an agglomerating agent were added to the mixture. The mixture was stirred at 11,000 rpm for 6 minutes by using a homogenizer, and 437 g of the mixed solution of the resin latexes synthesized in Preparation Examples 1 and 2 (95% by eight of L-LTX and 5% by weight of H-LTX) was added to the mixture and stirred further for 6 minutes to prepare core-layer particles having a volume average particle diameter of about 1.5 to about 2.5 μm. The resultant mixed solution was added to a 7 L double-jacketed reactor, and the temperature was increased at a rate of 0.5° C./min, from room temperature, to 55° C. (a temperature equal to or higher than $T_g$-5 degree of latex). When the volume average diameter of the core-layer particles reached about 6.0 μm, 442 g of the mixed solution of the resin latexes synthesized in Preparation Examples 1 and 2 (90% by weight of L-LTX and 10% by weight of H-LTX) was slowly further added for 20 minutes. When the volume average particle diameter of the thus coated core particles reached 6.8 μm, a NaOH solution (1 mol) was added to adjust the pH to 7. When the volume average particle diameter was maintained constant for 10 minutes, the temperature was increased to 96° C. at a rate of 0.5° C./min. When the temperature reached 96° C., a nitric acid (0.3 mol) was added to the reaction solution to adjust the pH to 6.0, followed by coalescence for about 3 hours to 5 hours to obtain a secondary agglomerated toner including potato-like particles. The agglomerated reaction solution was cooled down, at a rate of 2.0° C./min, to a temperature below the glass transition temperature Tg by using cooling water of 25-27° C., and heated again to a temperature of about 55-60° C., and then adjusted to pH 8.5 using an aqueous NaOH solution. Afterward, washing was performed several times with deionized water. The washed toner particles were recovered and dried.

0.5 parts by weight of NX-90 (available from Nippon Aerosil Co., Ltd. of Osaka, Japan), 1.0 part by weight of RX-200 (Nippon Aerosil Co., Ltd.), and 0.5 parts by weight of SW-100 (available from Titan Kogyo Kabushiki Kaisha of Ube, Japan) were externally added to 100 parts by weight of the dried toner particles and stirred using a mixer (KM-LS2K, available from DAEWHA TECH Co., Ltd. of Yong-In, South Korea) at a rate of 8,000 rpm for 4 minutes. As a result, toner having a volume average particle diameter of about 6.7 μm was obtained. The GSDp and GSDv of the toner were about 1.282 and about 1.217, respectively. The average circularity of the toner was about 0.971.

Example 2

Toner having a volume average particle diameter of about 6.8 μm was prepared in the same manner as in Example 1, except that 800 g, instead of 700 g, of the mixed solution of the resin latexes synthesized in Preparation Examples 1 and 2 (95% by weight of L-LTX and 5% by weight of H-LTX) was used, and after stirring using a homogenizer at 11,000 rpm for 6 minutes, 337 g of the mixed solution of the resin latexes synthesized in Preparation Examples 1 and 2 (95% by weight of L-LTX and 5% by weight of H-LTX) was further added and stirred for an additional 6 minutes. The GSDp and GSDv of the toner were about 1.28 and about 1.23, respectively. The average circularity of the toner was about 0.972.

Example 3

Toner having a volume average particle diameter of about 6.7 μm was prepared in the same manner as in Example 1, except that 900 g, instead of 700 g, of the mixed solution of the resin latexes synthesized in Preparation Examples 1 and 2 (95% by weight of L-LTX and 5% by weight of H-LTX) was used, and after stirring using a homogenizer at 11,000 rpm for 6 minutes, 237 g of the mixed solution of the resin latexes synthesized in Preparation Examples 1 and 2 (95% by weight of L-LTX and 5% by weight of H-LTX) was further added and stirred for an additional 6 minutes. The GSDp and GSDv of the toner were about 1.27 and about 1.23, respectively. The average circularity of the toner was about 0.973.

Comparative Example 1

Toner having a volume average particle diameter of about 6.8 μm was prepared in the same manner as in Example 1, except that 1137 g of the mixed solution of the resin latexes synthesized in Preparation Examples 1 and 2 (700 g and 417 g, respectively) (95% by weight of L-LTX and 5% by weight of H-LTX) was added together instead of separately. The GSDp and GSDv of the toner were about 1.27 and about 1.25, respectively. The average circularity of the toner was about 0.969.

Comparative Example 2

Toner having a volume average diameter of about 6.8 μm was prepared in the same manner as in Comparative Example 1, except that Mogul L (Cabot), instead of REGAL 330 (Cabot), was used as the carbon black colorant. The GSDp and GSDv of the toner were about 1.26 and about 1.22, respectively. The average circularity of the toner was about 0.971.

Comparative Example 3

Toner having a volume average diameter of about 6.7 μm was prepared in the same manner as in Comparative Example 1, except that Mogul E (Cabot), instead of REGAL 330 (Cabot), was used as the carbon black colorant. The GSDp and GSDv of the toner were about 1.270 and about 1.228, respectively. The average circularity of the toner was about 0.971.

Comparative Example 4

Toner having a volume average diameter of about 6.7 μm was prepared in the same manner as in Comparative Example 1, except that Regal 250R (Cabot), instead of REGAL 330 (Cabot), was used as the carbon black colorant. The GSDp and GSDv of the toner were about 1.270 and about 1.228, respectively. The average circularity of the toner was about 0.973.

Comparative Example 5

Toner having a volume average diameter of about 6.9 μm was prepared in the same manner as in Comparative Example 1, except that Monarch (Cabot), instead of REGAL 330 (Cabot), was used as the carbon black colorant. The GSDp and GSDv of the toner were about 1.270 and about 1.228, respectively. The average circularity of the toner was about 0.973.

Evaluation of Toner

<Measurement of Weight Average Molecular Weight and Z-Average Molecular Weight>

Weight average molecular weight (Mw) and Z-average molecular weight of toner were measured using a gel permeation chromatography (GPC) instrument (available from Alliance Company). An RI detector Waters 2414, was used as a detector and the three columns used were Strygel HR 5, 4, and 2. The mobile phase was tetrahydrofuran (THF), and the flow rate was 1 ml/min. The concentration and the injection volume of the sample were 1 wt % and 50 ul, respectively. Ten standard samples were used at a 0.5 wt % concentration for calibration. Compositions of the standard sample solutions were as follows:

Standard sample solution 1: molecular weights of 1,200, 7,210, 196,000, 257,000, and 1,320,000, and THF were mixed in a volume ratio of 1:1:1:1:0.5:0.5

Standard sample solution 1: molecular weights of 3,070, 49,200, 113,000, 778,000, and 3,150,000, and THF were mixed in a volume ratio of 1:1:1:1:0.5:0.5.

<Measurement of 600-nm UV Absorbance of Free Carbon Black>

One part by weight of toner, 90 parts by weight of deionized water, and 0.5 parts by weight of a surfactant (triton ×100) were placed in a sample bottle, which was then ultrasonicated for 1 hour to wash the toner, followed by centrifugation at 5,000 rpm for 5 minutes to isolate the toner. The supernatant was separated from the centrifuged product by using a pipet, and subjected to an absorbance measurement at 600 nm using a spectrophotometer (available from Hitachi Ltd.). The evaluation criteria were as follows:

Evaluation Criteria

◎: absorbance<0.01

○: 0.01≤absorbance<0.02

Δ: 0.02≤absorbance<0.05 x: absorbance≥0.1

<Measurement of Log Value of Resistance of Toner>

The log value of resistance of toner was obtained using a Wayne Kerr measuring instrument, and the following equation.

$$\text{Log}(R)=\text{Log}\,[(\text{Electrode's area } S)/(\text{Conductance}(C)\times \text{Sample thickness}(I))]$$

<Measurement of Toner Shell Layer>

The average thickness of toner shell layer was measured using transmission electron microscopy (TEM), where the average thicknesses of the shell layers of ten toner particles on a TEM image were measured. The evaluation criteria were as follows:

Evaluation Criteria

◎: 0.3 μm≤Thickness<0.5 μm

○: 0.1 μm≤Thickness<0.3 μm

Δ: 0.05 μm≤Thickness<0.1 μm x: Thickness<0.05 μm

<Measurement of Toner's Circularity>

The circularity and coefficient of variation (CV) of toner were obtained by using a flow particle image analyzer (FPIA-3000, available from SYSMEX Corporation) and the following equation, where 0.02 g of the toner was dispersed in 18 ml of distilled water with 0.3 wt % of Contaminon as a surfactant, and 30,000 toner particles in the dispersion were measured.

$$\text{Circularity}=2\times(\pi\times\text{area})^{0.5}/\text{circumference}$$

The circularity may be in the range of 0 to 1, and as the circularity approaches 1, the shape of toner particles becomes more circular.

<Measurement of Volume Average Diameter and Diameter Distribution of Toner>

Particle diameters of toner were measured using a particle sizing and counting analyzer Multisizer™ III (Beckman Coulter, Inc.), where 18 ml of distilled water, 0.3 wt % of Contaminon as a surfactant, and 0.02 g of toner powder was put in a 20 ml glass vial, and dispersed using a sonicator for about 15-30 minutes before the particle diameters were measured. A particle diameter at 50% of cumulative volume, D50v, is defined as a volume average particle diameter. Particle diameters at 85% of cumulative volume and number are defined as a volume average particle diameter D84v and a number average particle diameter D84p, respectively.

The GSDv and the GSDp may be obtained using the fact that the GSDv is defined as $(D84v/D16v)^{0.5}$ and the GSDp is defined as $(D84p/D16p)^{0.5}$.

<X-Ray Fluorescence Measurement>

An X-ray fluorescence measurement of each of the samples was performed using an energy dispersive X-ray spectrometer (EDX-720, available from SHIMADZU Corp. of Kyoto, Japan). An X-ray tube voltage was 50 kV, and the amounts of molded samples were each 3 g±0.01 g. For each sample, [S]/[Fe] was calculated using intensities (unit: cps/uA) measured using quantitative results obtained from the X-ray fluorescence measurement.

TABLE 2

| | Main peak location (Mp, g/mol) | Shoulder start point (g/mol) | Weight average molecular weight of toner (Mw, g/mol) | Z-average molecular weight (Mz, g/mol) | UV absorbance of free carbon black at 600 nm | Log resistance (log R) |
|---|---|---|---|---|---|---|
| Example 1 | 23751 | 60530952 | 75092 | 2590721 | 0.001 | 13.8 |
| Example 2 | 22984 | 61715849 | 77242 | 3021622 | 0.009 | 13.2 |
| Example 3 | 24135 | 57739920 | 70511 | 2667549 | 0.008 | 13.1 |
| Comparative Example 1 | 25529 | 52337244 | 66728 | 2335128 | 0.011 | 13.0 |
| Comparative Example 2 | 22887 | 50295640 | 69029 | 2890072 | 0.015 | 12.0 |
| Comparative Example 3 | 24401 | 53906421 | 70327 | 3178996 | 0.020 | 11.6 |
| Comparative Example 4 | 23549 | 63776820 | 68225 | 3125337 | 0.013 | 11.5 |
| Comparative Example 5 | 24126 | 62112755 | 75230 | 3307756 | 0.012 | 11.2 |

<Evaluation of Toner's Charging Characteristics>

18.4 g of a carrier (35 μm-sized spherical magnetic particles) and 1.6 g of toner were placed in 60 mL of a glass vial and were stirred with a turbula mixer. The amount of toner charged was measured using electric field separation.

Charge stability of toner with respect to a mixing time at room temperature in room humidity, and a ratio of a charge amount at high-temperature and high-humidity (HH environment) to a charge amount at low-temperature and low-humidity (LL environment) were used as evaluation indices.

Room temperature/normal humidity; 23° C., relative humidity (RH) 55%

High-temperature and high-humidity: 30° C., RH 82%

Low-temperature and low-humidity: 10° C., RH 10%

Charge Stability

Charge stability of toner was calculated as (Charge value after stirring for 1 minutes/Charge value after stirring for 10 minutes)*100(%), and the evaluation criteria were as follows:

○: 80≤Charge stability≤100

Δ: 60≤Charge stability≤80 x: Charge stability<60

Charge Ratio Between Environments (H/L)

A charge ratio after 10-min stirring in HH environment to in LL environment was calculated and the evaluation criteria were as follows:

◎: 0.99~0.70

○: 0.69~0.50 x: less than 0.50, or equal to or greater than 1.00

<Transfer Efficiency Evaluation>

Using a Samsung CRP-325 Printer set (available from Samsung Electronics Co. Ltd), a regional ratio of toner in grams in an image transfer belt (ITB) to in an organic photoconductor (OPC) was calculated, and the evaluation criteria were as follows:

◎: 0.9≤Transfer efficiency≤1.0

Δ: 0.7≤Transfer efficiency≤0.9 x: Transfer efficiency<0.7

TABLE 3

| | GSDp | GSDv | Average circularity | Charging stability | Charge ratio between environments (H/L) | Transfer efficiency |
|---|---|---|---|---|---|---|
| Example 1 | 1.282 | 1.217 | 0.971 | o | o | ◎ |
| Example 2 | 1.28 | 1.23 | 0.972 | o | o | ◎ |
| Example 3 | 1.27 | 1.23 | 0.972 | o | o | ◎ |
| Comparative Example 1 | 1.27 | 1.25 | 0.969 | o | x | Δ |
| Comparative Example 2 | 1.26 | 1.22 | 0.971 | Δ | x | Δ |
| Comparative Example 3 | 1.27 | 1.228 | 0.971 | x | x | Δ |
| Comparative Example 4 | 1.27 | 1.228 | 0.973 | x | x | x |
| Comparative Example 5 | 1.27 | 1.228 | 0.973 | x | x | x |

Referring to Tables 2 and 3, the toners of Examples 1-3 are found to have better charge stabilities and transfer efficiencies compared to those of Comparative Examples 1-5.

This is attributed to the fact that the toners of Examples 1-3 were prepared by separately adding the mixed solution of the resin latexes twice to allow toner particles for both core and shell layers to have core/shell structures. As a result, a larger amount of carbon black may be stably dispersed in the core layers of toner, while a remarkably reduced amount of carbon black remains free, compared to the toners of Comparative Examples 1-5 having a single-layered core structure.

As described above, according to the one or more embodiments of the present general inventive concept, a low-molecular weight resin that leads to a minimum fusing temperature (MFT) and gloss, and a large-molecular weight resin that contributes to anti-offset characteristics by maintaining elasticity of toner at high temperatures may work independently from each other to ensure a wide latex fusing latitude and a constant fusing latitude irrespective of printing speeds. The sufficient dispersion of carbon black in toner may ensure the improved characteristics of the toner, in terms of charging stability with respect to environmental conditions, durability in development, and image stability.

While the present general inventive concept has been particularly shown and described with reference to exemplary embodiments thereof, it will be understood by those of ordinary skill in the art that various changes in form and details may be made therein without departing from the spirit and scope of the present general inventive concept as defined by the following claims.

What is claimed is:

1. An electrophotographic toner comprising:

a binder comprising two resins having different weight average molecular weights;

carbon black; and a releasing agent, wherein the electrophotographic toner has a molecular weight distribution curve measured by gas permeation chromatography (GPC), with a main peak in a region of from about $8.0\times10^3$ g/mol to about $4.0\times10^4$ g/mol and a shoulder starting point in a region greater than or equal to about $1.0\times10^5$ g/mol;

the electrophotographic toner has a weight average molecular weight of from about $5.0\times10^4$ g/mol to about $4.0\times10^5$ g/mol and a Z-average molecular weight of from about $1.0\times10^5$ g/mol to about $6.0\times10^6$ g/mol;

free carbon black in washer liquid of deionized water containing 1 wt % of the electrophotographic toner has an absorbance of about 0 to about 0.01 at 600 nm; and wherein the electrophotographic toner comprises iron (Fe) in an amount of from about $1.0\times10^3$ ppm to about $1.0\times10^4$ ppm, and silicon (Si) in an amount of from about $1.0\times10^3$ ppm to about $5.0\times10^3$ ppm.

2. The electrophotographic toner of claim 1, wherein the electrophotographic toner has a structure including a core and a shell layer, and the shell layer has a thickness of about 0.1 μm to about 0.5 μm.

3. The electrophotographic toner of claim 1, wherein a [S]/[Fe] ratio of the toner is in the range of from about $5.0\times10^{-4}$ to about $5.0\times10^{-2}$, where [S] and [Fe] respectively denote the intensities of S and Fe measured by X-ray fluorescence spectrometry.

4. The electrophotographic toner of claim 1, wherein an average particle diameter of the electrophotographic toner is in a range of from about 4.0 μm to about 9.0 μm.

5. The electrophotographic toner of claim 1, wherein the electrophotographic toner has a GSDp of from about 1.0 to about 1.35, and a GSDv of from about 1.0 to about 1.3.

* * * * *